US007666350B2

(12) United States Patent
Yaguchi et al.

(10) Patent No.: US 7,666,350 B2
(45) Date of Patent: Feb. 23, 2010

(54) LOW CARBON COMPOSITE FREE-CUTTING STEEL PRODUCT EXCELLENT IN ROUGHNESS OF FINISHED SURFACE AND METHOD FOR PRODUCTION THEREOF

(75) Inventors: Hiroshi Yaguchi, Kobe (JP); Koichi Sakamoto, Kobe (JP); Tomoko Sugimura, Kobe (JP); Goro Anan, Kobe (JP); Katsuhiko Ozaki, Kobe (JP)

(73) Assignee: Kabushiki Kaisha Kobe Seiko Sho, Kobe-shi (JP)

( * ) Notice: Subject to any disclaimer, the term of this patent is extended or adjusted under 35 U.S.C. 154(b) by 267 days.

(21) Appl. No.: 10/579,798

(22) PCT Filed: Nov. 26, 2004

(86) PCT No.: PCT/JP2004/017600

§ 371 (c)(1),
(2), (4) Date: May 18, 2006

(87) PCT Pub. No.: WO2005/054532

PCT Pub. Date: Jun. 16, 2005

(65) Prior Publication Data

US 2007/0044867 A1 Mar. 1, 2007

(30) Foreign Application Priority Data

Dec. 1, 2003 (JP) ..... 2003-401831
Aug. 31, 2004 (JP) ..... 2004-252798

(51) Int. Cl.
*C22C 38/60* (2006.01)
*C22C 38/00* (2006.01)

(52) U.S. Cl. ..... 420/87; 420/128; 148/320

(58) Field of Classification Search ..... 420/87, 420/128; 148/320
See application file for complete search history.

(56) References Cited

U.S. PATENT DOCUMENTS 6,635,129 B1 10/2003 Nagahama et al.

FOREIGN PATENT DOCUMENTS

EP 1 484 422 A1 12/2004

(Continued)

OTHER PUBLICATIONS

U.S. Appl. No. 12/095,040, filed May 27, 2008, Sakamoto et al.

(Continued)

*Primary Examiner*—Roy King
*Assistant Examiner*—Caitlin Fogarty
(74) *Attorney, Agent, or Firm*—Oblon, Spivak, McClelland, Maier & Neustadt, L.L.P.

(57) ABSTRACT

The present invention provides a low-carbon resulfurized free machining steel product excellent in machinability typified by finished surface roughness even though toxic Pb or special elements such as Bi or Te are not added, and a suitable production method thereof. A steel product has a specific composition, has contents of Mn and S satisfying the following conditions: $0.40 \leqq Mn*S \leqq 1.2$ and $Mn/S \geqq 3.0$, and contains a ferrite-pearlite structure as the metallographic structure, in which the average width (μm) of sulfide inclusions in the steel product is 2.8*(log d) or more, wherein d (mm) is the diameter of the steel product, and pro-eutectoid ferrite in the metallographic structure has a hardness HV of 133 to 150 or a difference in deformation resistance at a strain of 0.3 between 200° C. and 25° C. is 110 MPa or more and 200 MPa or less, the deformation resistances being determined in a compression test at a deformation rate of 0.3 mm/min.

20 Claims, 2 Drawing Sheets

FOREIGN PATENT DOCUMENTS

| | | |
|---|---|---|
| JP | 56-105460 | 8/1981 |
| JP | 63-004903 | 2/1988 |
| JP | 3-264648 | 11/1991 |
| JP | 4-54735 | 9/1992 |
| JP | 4-54736 | 9/1992 |
| JP | 7-11059 | 2/1995 |
| JP | 7-173574 | 7/1995 |
| JP | 8-000949 | 1/1996 |
| JP | 2740982 | 1/1996 |
| JP | 9-31522 | 2/1997 |
| JP | 9-71838 | 3/1997 |
| JP | 9-157791 | 6/1997 |
| JP | 10-158781 | 6/1998 |
| JP | 10-211506 | 8/1998 |
| JP | 2922105 | 4/1999 |
| JP | 11-293391 | 10/1999 |
| JP | 2001-207240 | 7/2001 |
| JP | 2003-253390 | 9/2003 |
| KR | 2001-0051588 | 6/2001 |

OTHER PUBLICATIONS

U.S. Appl. No. 11/997,612, filed Feb. 1, 2008, Sakamoto et al.

LOW CARBON COMPOSITE FREE-CUTTING STEEL PRODUCT EXCELLENT IN ROUGHNESS OF FINISHED SURFACE AND METHOD FOR PRODUCTION THEREOF

TECHNICAL FIELD

The present invention relates to a low-carbon resulfurized free machining steel product which is free of lead (Pb) and has satisfactory machinability, and to a production method thereof. The "steel product" herein refers typically to hot-rolled steel bars and steel rods.

BACKGROUND ART

Low-carbon resulfurized free machining steel products are used in small parts, such as screws and nipples, which do not require mechanical properties so high but require good machinability and are manufactured in large quantity by cutting. Free machining steel products containing Pb in addition to S are widely used as free machining steel products having further satisfactory machinability. Pb is a harmful substance which deteriorates health, and demands have been made to reduce the content of Pb in such free machining steel products. Tellurium (Te) is also used in some free machining steel products, but it has toxicity and deteriorates hot workability and must be reduced.

Many investigations have been made to improve the machinability of low-carbon resulfurized free machining steel products, many of which relate to control in number, size and configuration of sulfide inclusions (refer to Patent Documents 1, 2, 3, 4, 5 and 6).

Patent Document 7 pointes that the oxygen content in steel products is important to control the size and configuration of sulfide inclusions. Patent Document 8 indicates that the control of oxygen content in molten steel before tapping is important.

Many techniques relate to control of oxide inclusions (refer to Patent Documents 9, 10, 11, 12 and 13).

The structure and properties (matrix properties) other than such inclusions also significantly affect the machinability, but there are few techniques noting these factors. For example, there are only few techniques such as one specifying a streaky pearlite structure continuously extending in the rolling direction (Patent Document 14) and one specifying the content of dissolved carbon in pro-eutectoid ferrite (Patent Document 15).

Patent Document 16, for example, proposes a low-carbon resulfurized free machining steel product which contains 0.16 to 0.5 percent by weight of S, 0.003 to 0.03 percent by weight of N, and 100 ppm to 300 ppm of oxygen, whose nitrogen (N) is contained in an amount more than conventional free machining steel products manufactured by continuous casting. The resulting free machining steel product can reduce built-up edge formed on a tool face during machining and has machinability equal to or higher than ingot steel products.

Patent Document 1: Japanese Patent No. 1605766 (claims)

Patent Document 2: Japanese Patent No. 1907099 (claims)

Patent Document 3: Japanese Patent No. 2129869 (claims)

Patent Document 4: Japanese Patent Application Laid-open (JP-A) No. 09-157791 (claims)

Patent Document 5: Japanese Patent Application Laid-open (JP-A) No. 11-293391 (claims)

Patent Document 6: Japanese Patent Application Laid-open (JP-A) No. 2003-253390 (claims)

Patent Document 7: Japanese Patent Application Laid-open (JP-A) No. 09-31522 (claims)

Patent Document 8: Japanese Patent Application Laid-open (JP-A) No. 56-105460 (claims)

Patent Document 9: Japanese Patent No. 1605766 (claims)

Patent Document 10: Japanese Patent No. 1907099 (Japanese Patent Application Publication No. 04-54736) (claims)

Patent Document 11: Japanese Patent No. 2922105 (claims)

Patent Document 12: Japanese Patent Application Laid-open (JP-A) No. 09-71838 (claims)

Patent Document 13: Japanese Patent Application Laid-open (JP-A) No. 10-158781 (claims)

Patent Document 14: Japanese Patent No. 2125814 (Japanese Patent Application Publication (JP-B No. 07-11059) (claims)

Patent Document 15: Japanese Patent No. 2740982 (claims)

Patent Document 16: Japanese Patent No. 2129869 (Japanese Patent Application Publication (JP-B) No. 08-949) (claims)

DISCLOSURE OF THE INVENTION

Problems to be Solved by the Invention

The respective techniques disclosed in the above publications do not yield sufficient machinability particularly in finished surface roughness in forming process, although they play an important role in improvement of machinability of free machining steel products.

The technique disclosed in Patent Document 8, for example, controls inclusions in a steel product so that the content of MnS in the total MnS inclusions is 50% or more, which MnS having a major axis of 5 μm or more, a minor axis of 2 μm or more and a ratio of the major axis to the minor axis of 5 or less, and the average content of $Al_2O_3$ in oxide inclusions is 15% or less. However, this steel product must contain Pb, Bi and Te in a total content of 0.2% or more and cannot yield sufficient machinability without the addition of these elements.

The techniques disclosed in Patent Documents 7 and8 control the oxygen content in a steel product or molten steel for controlling the size and configuration of sulfide inclusions. However, these steel products actually contain oxygen at a high content of 100 to 500 ppm. Such a high oxygen content frequently induces oxide inclusions which are harmful to the machinability and also invites blow holes causing surface flaws.

The present invention has been accomplished in view of these problems, and an object of the present invention is to provide a low-carbon resulfurized free machining steel product with satisfactory machinability typified by finished surface roughness even though toxic Pb or special elements such as Bi or Te is not added and to provide a suitable production method thereof.

Means for Solving the Problems

To achieve the above objects, the present invention provides, in an aspect, a low-carbon resulfurized free machining steel product excellent in finished surface roughness, comprising, on the percent by mass basis, C: 0.02% to 0.12%, Si: 0.01% or less, Mn: 1.0% to 2.0%, P: 0.05% to 0.20%, S: 0.30% to 0.60%, N: 0.007% to 0.03%, with the balance being Fe and inevitable impurities, the contents of Mn and S satisfying the following conditions: $0.40 \leqq Mn*S \leqq 1.2$ and $Mn/S \geqq 3.0$, and the steel product having a ferrite-pearlite structure as its metallographic structure, wherein the average width (pm) of sulfide inclusions in the steel product is 2.8* (log d) or more, wherein d is the diameter (mm) of the steel product, and pro-eutectoid ferrite in the metallographic structure has a hardness HV of 133 to 150.

The present invention provides, in another aspect, a low-carbon resulfurized free machining steel product excellent in finished surface roughness comprising, on the percent by mass basis, C: 0.02% to 0.12%, Si: 0.01% or less, Mn: 1.0% to 2.0%, P: 0.05% to 0.20%, S: 0.30% to 0.60%, N: 0.007% to 0.03%, with the balance being Fe and inevitable impurities, the contents of Mn and S satisfying the following conditions: $0.40 \leqq Mn*S \leqq 1.2$ and $Mn/S \geqq 3.0$, and the steel product having a ferrite-pearlite structure as its metallographic structure, wherein the average width (μm) of sulfide inclusions in the steel product is 2.8*(log d) or more, wherein d is the diameter (mm) of the steel product, and a difference in deformation resistance at a strain of 0.3 between 200° C. and 25° C. is 110 MPa or more and 200 MPa or less, the deformation resistances being determined at a deformation rate of 0.3 mm/min in a compression test.

In addition, the present invention provides a suitable method for producing the low-carbon resulfurized free machining steel product excellent in finished surface roughness. Specifically, the present invention provides a method for producing a low-carbon resulfurized free machining steel product excellent in finished surface roughness, comprising the steps of casting a steel having the above composition, and controlling, before the step of casting, free oxygen (Of) to a content of 30 ppm or more and less than 100 ppm and the ratio Of/S of Of to S to within a range from 0.005 to 0.030, Of and S being contained in molten steel before casting.

Advantages

The finished surface roughness of a free machining steel product varies significantly depending on occurrence, size, shape and uniformity of a built-up edge. The built-up edge is a phenomenon that part of a work material attaches to a surface of a tool and behaves as part of the tool. It particularly deteriorates initial finished surface roughness of a work material. The built-up edge occurs only under specific conditions, but free machining steel products are frequently cut in the art under such conditions as to invite the built-up edge.

On the other hand, the built-up edge plays a role to protect the edge of a tool to thereby prolong the life of the tool. All factors considered, therefore, it is not advantageous to remove (to prevent the occurrence of) such a built-up edge, and it is important to form a built-up edge stably and uniformize the size and shape thereof.

The present invention enables stable formation of a built-up edge and uniform size and shape thereof by the action of large-sized spherical MnS inclusions and an increased content of dissolved N. In addition, the present invention enables further stable formation of a built-up edge having further uniformized size and shape by controlling the hardness of pro-eutectoid ferrite in a metallographic structure of a steel containing a ferrite-pearlite composite structure.

Another significant feature of the present invention is to stabilize the built-up edge, as in the control of the hardness of the pro-eutectoid ferrite, by controlling the difference in deformation resistance between high temperatures and room temperature in a compression test of a steel product to a suitable range instead of controlling the hardness of pro-eutectoid ferrite.

By these means, the present invention enables improved finished surface roughness of a steel product typically in forming process.

BEST MODE FOR CARRYING OUT THE INVENTION

Steel Product Structure

Figure 1:
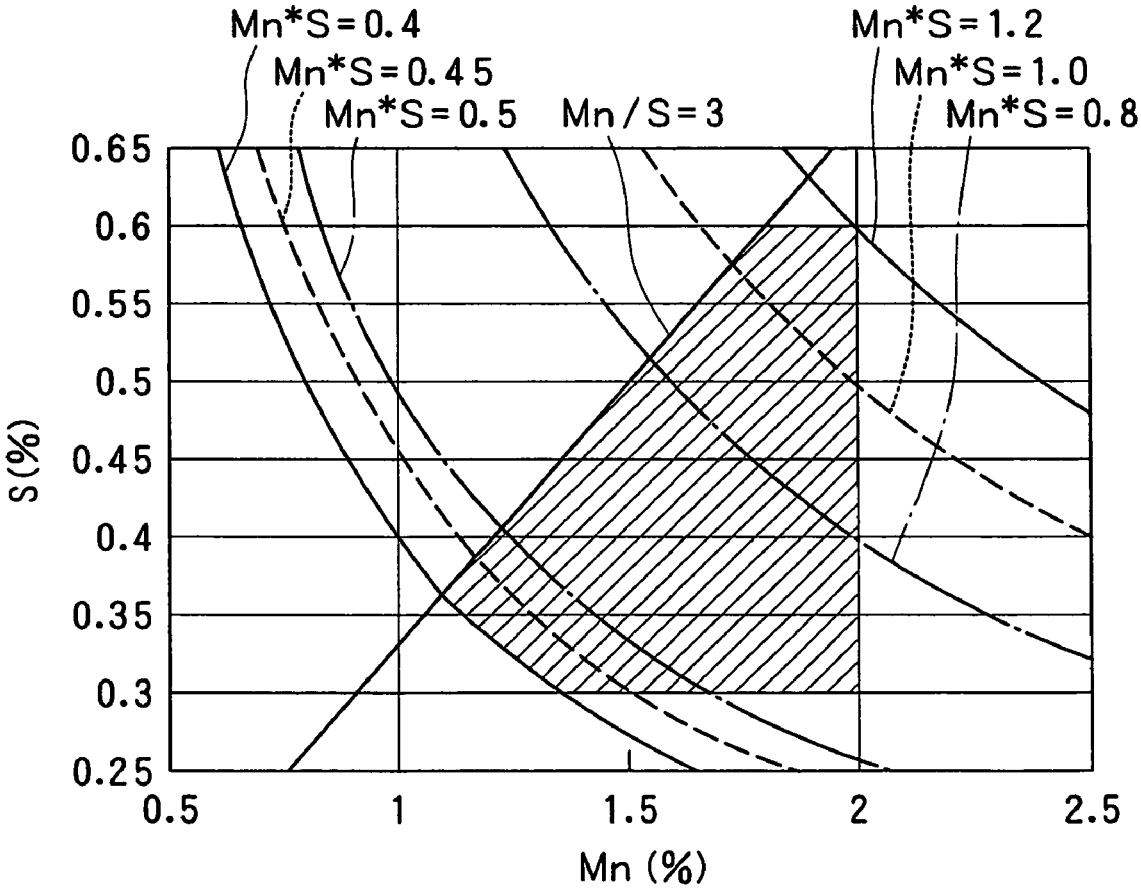
FIG. 1 is an explanatory view showing the relationship between the contents of Mn and S in the present invention.

The low-carbon resulfurized free machining steel product of the present invention essentially has a composite structure of ferrite and pearlite for improving the machinability. In addition, the present invention controls the hardness of pro-eutectoid ferrite in the composite metallographic structure to a hardness HV in a range from 133 to 150, and preferably to a hardness HV in a range from 135 to 145 for improving finished surface roughness in forming process.

This reduces work hardening of a free machining steel product during cutting, enables stable formation of a built-up edge with uniformized size and shape and improves finished surface roughness typically informing process. Of such factors, work hardening of a free machining steel product during cutting significantly affects the stability of a built-up edge. The built-up edge can be stably formed by reducing work hardening during cutting. Accordingly, the control of hardness of pro-eutectoid ferrite can be said as a control to reduce work hardening of a free machining steel product during cutting or to reduce the work hardening to an optimal range.

If the hardness of pro-eutectoid ferrite exceeds HV of 150, or more strictly exceeds HV of 145, the work hardening of the free machining steel product decreases, but the pro-eutectoid ferrite becomes excessively hard to increase cutting force to thereby accelerate abrasion of a tool. This shortens the life of the tool and deteriorates the finished surface roughness.

In contrast, if the hardness of the pro-eutectoid ferrite is less than HV of 133, or more strictly less than HV of 135, the pro-eutectoid ferrite becomes excessively soft to thereby markedly increase work hardening of a free machining steel product during cutting. This results in unstable formation of built-up edge with heterogenous size and shape to thereby deteriorate the finished surface roughness markedly.

The control of the hardness of pro-eutectoid ferrite also improves the machinability after cold drawing. Consequently, the hardness control also yields equivalent machinability even at a decreased reduction of area in cold drawing or cold wire drawing, in other words, regardless of the processing rate of these cold workings. The conventional cold workings such as cold drawing and cold wire drawing are generally carried out before cutting of a free machining steel product for improving the shape and/or dimensional accuracy of a free machining steel product, as well as for improving the machinability. However, a considerably high reduction of area is required for improving the machinability, and this adversely affects the shape and dimensional accuracy, improvement of which is an primary object of cold working, to thereby decrease the workability and efficiency of the cold working. The present invention, however, enables cold working in order only to improve the shape and dimensional accuracy of a free machining steel product, which is a primary object of the cold working. This is a great advantage. In addition, the present invention enables equivalent machinability regardless of reduction of area, or even at a decreased reduction of area in cold working.

The hardness of pro-eutectoid ferrite can be determined by exposing the metallographic structure of a sample by etching and measuring the hardness of pro-eutectoid ferrite alone in the exposed steel product structure using a miniature Vickers hardness tester with a load of 5 kg or less. In this procedure, the hardness is determined on a minute potion of the steel product, which may exhibit some variation. Accordingly, the hardness of plural points, for example, about fifteen points, is measured in a longitudinal direction and/or a diameter (thickness) direction of the sample steel product, and the average of measured hardness is defined as the hardness of pro-eutectoid ferrite. The hardness can be determined naturally at fifteen or more point. The measured data on hardness may include an excessively high hardness or excessively low hardness in view of average level of the measured data, since minute pro-eutectoid ferrite potions are subjected to measurement. In this case, the average is preferably determined after excluding such data.

The hardness of pro-eutectoid ferrite is controlled by solid-solution strengthening as a result of combination of after-mentioned specific elements such as P and N, and additionally Cu and Ni, and combination of after-mentioned production conditions such as temperature of hot rolling, and cooling rate after hot rolling. In addition to the above-mentioned elements, such solid-solution strengthening elements also include Si, Mn and Cr. The present invention, however, does not use these elements for the after-mentioned reasons.

Compression Test

The built-up edge can be stably formed by controlling the deformation resistance in a compression test of a steel product, instead of controlling the hardness of pro-eutectoid ferrite or directly measuring the hardness of pro-eutectoid ferrite as mentioned above. In other words, the stability of built-up edge formation can be determined by the deformation resistance in a compression test of a steel product, as in the hardness of pro-eutectoid ferrite.

As is described above, the built-up edge is a phenomenon that part of a work material attaches to a surface of a tool during cutting and contributes to cutting just like part of the tool. The built-up edge is formed from the work material and thereby repetitively grows and peels off during cutting. The size of the built-up edge may vary depending on the position of the tool, which affects the finished surface roughness of the resulting free machining steel product. The built-up edge yields chips at the interface between the chips and the built-up edge because of locally receiving great plastic deformation. The size of the built-up edge varies with varying point of plastic deformation. For stabilizing the built-up edge, therefore, it is preferred to allow the focus of plastic deformation to center at the interface between the built-up edge and chips constantly and to prevent shift thereof to other points.

The built-up edge has a temperature distribution. One of indications of the degree of focusing of plastic deformation is the difference between a deformation resistance at high temperatures and a deformation resistance at room temperature in a compression test of a steel product. By controlling the difference in deformation resistance between temperatures to within a suitable range, the focus of plastic deformation can be centered at the interface between the built-up edge and chips constantly to thereby stabilize the built-up edge, as in the control of hardness of pro-eutectoid ferrite. The difference in deformation resistance between temperatures is the difference in deformation resistance between 200° C. and 25° C. in a compression test as specified in the present invention. More specifically, it is the difference in deformation resistance at a strain of 0.3 between 200° C. and 25° C. as determined in a compression test at a deformation rate of 0.3 mm/min. According to the present invention, the difference in deformation resistance between 200° C. and 25° C. in the compression test should be 110 MPa or more and 200 MPa or less.

If the difference in deformation resistance between 200° C. and 25° C. is less than 110 MPa, the pro-eutectoid ferrite becomes excessively soft to thereby markedly increase the work hardening of a free machining steel product during cutting. Thus, the focus of plastic deformation shifts and does not center at the interface between the built-up edge and chips. This makes the built-up edge unstable with heterogenous size and shape to thereby markedly deteriorate the finished surface roughness.

In contrast, if the difference in deformation resistance between 200° C. and 25° C. exceeds 200 MPa, the pro-eutectoid ferrite becomes excessively hard with excessively high working resistance to thereby accelerate the abrasion of the tool. This shortens the life of the tool and deteriorates the finished surface roughness.

By optimizing the difference in deformation resistance between room temperature (25° C.) and 200° C. in a compression test of a steel product, the built-up edge can be stably formed as in the hardness control of the pro-eutectoid ferrite.

Figure 2:
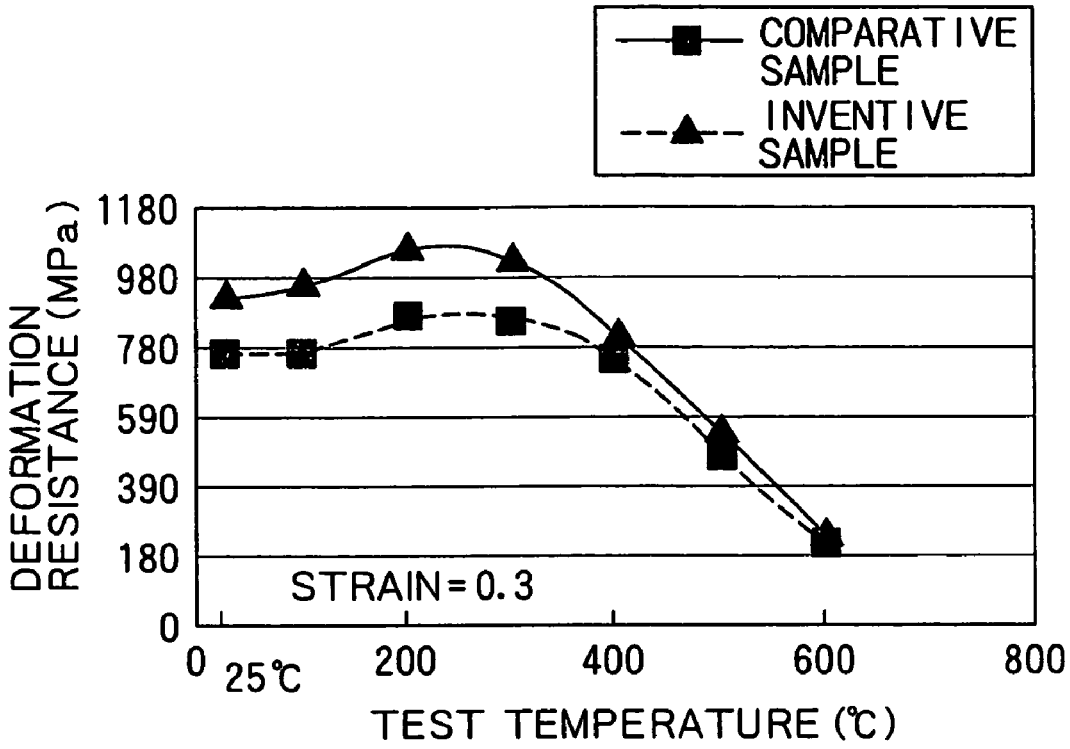
FIG. 2 is an explanatory view showing a change in deformation resistance of a steel product with temperature in a compression test.

FIG. 2 shows a change in deformation resistance of a steel product with temperature in a compression test. In FIG. 2, data indicated by black triangles are data of Inventive Sample 52 in Example 3 and data indicated by black squares are data of Comparative Sample 38 in Example 3. FIG. 2 shows deformation resistance at a strain of 0.3 in a compression test at a deformation rate of 0.3 mm/min.

FIG. 2 shows that the inventive sample has deformation resistances at the tested temperatures higher than those of the comparative example. In both the inventive sample and the comparative sample, the deformation resistance is likely to increase from at room temperature 25° C., attain the maximum at 200° C. and markedly decrease at temperatures higher than 200° C.

The difference in deformation resistance of a steel product between 25° C. (room temperature) and 200° C., within which the deformation resistance increases, significantly affects the degree of focusing of plastic deformation and the stabilization of the built-up edge. Consequently, the present invention defines the machinability by the difference in deformation resistance between 25° C. (room temperature) and 200° C.

The difference in deformation resistance between room temperature (25° C.) and 200° C. satisfactorily corresponds with the machinability of a steel product determined by the hardness of pro-eutectoid ferrite. In other words, the range showing a difference in deformation resistance between 200° C. and 25° C. in the compression test agrees with or satisfactorily corresponds with the range showing a hardness of pro-eutectoid ferrite in a composite metallographic structure of HV of 133 to 150.

Figure 3:
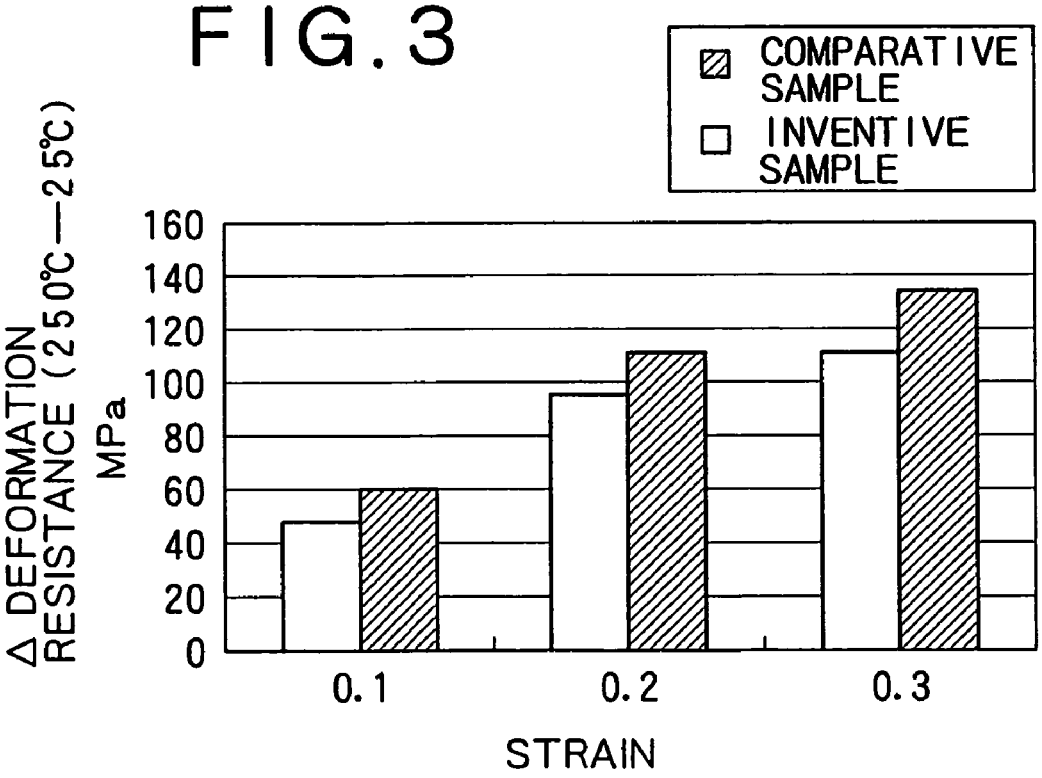
FIG. 3 is an explanatory view showing the relationship between the distortion and the difference in deformation resistance in a range from room temperature (25° C.) to 200° C. in a compression test of a steel product.

The difference in deformation resistance between room temperature (25° C.) and 200° C. becomes noticeable with an increasing strain in the compression test. FIG. 3 shows the differences in deformation resistance of the inventive sample and the comparative sample between room temperature (25° C.) and 200° C. at strains of 0.1, 0.2 and 0.3, respectively. In FIG. 3, data indicated by open bars are data of the comparative example, and those indicated by black bars are data of the inventive sample. The strain in the compression test herein is set at 0.3, since the difference in deformation resistance between room temperature (25° C.) and 200° C. does not so much vary between a strain of 0.3 and a strain higher than 0.3.

The difference in deformation resistance 200° C. and 25° C. at a strain of 0.3 determined in the compression test and specified in the present invention can be controlled as in the hardness control of pro-eutectoid ferrite. More specifically, it can be controlled by the solid-solution strengthening with combination of after-mentioned specific elements such as P and N, and additionally Cu and Ni, and a suitable combination of after-mentioned production conditions such as temperature of hot rolling and cooling rate after hot rolling.

Composition of Steel Product

The composition on the percent by mass basis of the low-carbon resulfurized free machining steel product of the present invention will be described below with reasons for specifying the respective elements.

The free machining steel product of the present invention is generally applied typically to small parts, such as screws and nipples, which do not require mechanical properties so high but require machinability and are produced in large quantity by cutting. The free machining steel product must also have properties such as strength at certain levels and workability in production of steel products such as wire rods and steel bars, in addition to the machinability required for these applications. The chemical composition of the steel product in its production plays a significant role to yield the ferrite-pearlite composite structure, in addition to the after-mentioned production conditions.

To satisfy the requirements in structure and properties, the steel product of the present invention comprises, as its basic chemical composition, on the percent by mass basis, C: 0.02% to 0.12%, Si: 0.01% or less, Mn: 1.0% to 2.0%, P: 0.05% to 0.20%, S: 0.30% to 0.60%, N: 0.007% to 0.03%, with the balance being Fe and inevitable impurities, in which the contents of Mn and S satisfy the following conditions: $0.40 \leqq Mn*S(=Mn \times S) \leqq 1.2$ and $Mn/S \geqq 3.0$.

Where necessary, the content of Cr is controlled to 0.04% or less and the total content of Ti, Nb, V, Al and Zr is controlled to 0.020% or less in the above composition, which elements are to be controlled as impurities.

If required, the composition further selectively comprises one or both of more than 0.30% and equal to or less than 1.0% of Cu, and more than 0.20% and equal to or less than 1.0% of Ni.

C: 0.02%-0.12%

The steel comprises C to ensure its strength, hardness of pro-eutectoid ferrite and difference in deformation resistance between 200° C. and 25° C. If the content of C is less than 0.02%, the steel has an insufficient strength and an insufficient hardness of the pro-eutectoid ferrite. In addition, the steel exhibits excessively high toughness and ductility and decreased machinability. In contrast, if the C content exceeds 0.12%, the steel exhibits excessively high strength and hardness of pro-eutectoid ferrite, which deteriorates the machinability instead of improving the same. Consequently, the lower limit of the C content is set at 0.02%, or preferably at 0.03%, and the upper limit thereof is set at 0.12%, or preferably at 0.07%.

Mn: 1.0% to 2.0%

Mn is combined with S in the steel to form a sulfide MnS to thereby improve the machinability. It also prevents hot shortness caused by formed FeS. To exhibit these advantages, the lower limit of Mn is set at 1.0%. Mn, however, has a deoxidation action and if it is contained in an amount exceeding 2.0%, it serves to deoxidize free oxygen (Of) in molten steel before casting and makes the steel short in Of necessary for yielding large-sized spherical MnS. In addition, the steel has excessively high strength to thereby decrease the machinability, instead. The upper limit of Mn is thereby set at 2.0%. The content of Mn is further controlled or specified in relation with after-mentioned S to thereby inhibit the deoxidation action and to make Mn mainly contribute to the formation of sulfide MnS.

P: 0.05% to 0.20%

P is an important element, by the action of solid solution strengthening, to control the hardness of pro-eutectoid ferrite to a range of HV of 133 to 150 and/or to control the difference in deformation resistance between 200° C. and 25° C. in the compression test, to thereby improve the machinability. More specifically, the present invention controls the hardness of pro-eutectoid ferrite and the difference in deformation resistance between 200° C. and 25° C. in the compression test to the above-specified ranges by suitable combination of the solid solution strengthening of P with the solid solution strengthening of N, or with the solid solution strengthening of Cu and/or Ni contained selectively, in further combination with the after-mentioned hot rolling temperature and the cooling rate after hot rolling. To exhibit these advantages, the steel product must contain 0.05% or more of P. In contrast, the upper limit of P is set at 0.20%, since the advantages reach saturation even if the steel product contains P in an amount exceeding 0.20%.

S: 0.30% to 0.60%

S is an element serving to improve the machinability by forming a sulfide with Mn. Such an advantage is excessively small at a S content of less than 0.30%. In contrast, a S content of exceeding 0.60% may deteriorate the hot workability. Accordingly the lower limit thereof is set at 0.30%, or preferably 0.35%, and the upper limit thereof is set at 0.60%, or preferably 0.50%.

In view of the relationship between S and Mn, the S content should be set so that the contents of Mn and S satisfy the conditions: $0.40 \leqq Mn*S(=Mn \times S) \leqq 1.2$ and $Mn/S \geqq 3.0$. FIG. 1 shows the relationship between the contents of Mn and S in the present invention, with the abscissa indicating the Mn content (%) and the ordinate indicating the S content (%). In FIG. 1, the straight line extending from the lower left to the upper right represents the lower limit of Mn/S, i.e., the straight line of Mn/S being 3.0, and curves extending from the lower right to the upper left represent Mn*S, respectively. The curves representing Mn*S indicate the curves at Mn*S of 0.40, 0.45, 0.5, 0.8, 1.0 and 1.2 from the left hand of the figure, respectively.

In FIG. 1, the area satisfying the condition: $Mn/S \geqq 3.0$ is an area below the straight line of Mn/S being 3.0. The area in which Mn*S is 0.40 or more is an upper area of the curve of Mn*S of 0.40. The area in which Mn*S is 1.2 or less is an area below the curve of Mn*S of 1.20. The range in which the contents of Mn and S satisfy all the above requirements in contents and the conditions: $0.40 \leqq Mn*S \leqq 1.2$ and $Mn/S \geqq 3.0$ in the present invention is the diagonally shaded area. Mn*S of 0.45 and Mn*S of 0.5 represent preferred and more preferred lower limits of Mn*S, respectively. Mn*S of 1.0 and Mn*S of 0.8 represent preferred and more preferred upper limits of Mn*S, respectively.

If the contents of Mn and S stand so that Mn*S exceeds the upper limit of the above-specified range of 0.40 to 1.2, preferred range of 0.45 to 1.0, and more preferred range of 0.5 to 0.8, the S content is excessively high so as to reduce the free oxygen necessary for the control the configuration of MnS. This deteriorates the machinability. In contrast, if Mn*S is less than the above lower limits, the absolute content of MnS decreases to thereby deteriorate the machinability, or the free oxygen content increases to increase the danger of formation of blow holes.

A ratio Mn/S less than 3.0 invites formation of FeS to reduce the workability such as hot rolling workability to thereby fail to produce the steel product.

Si: 0.01% or less

Si has a deoxidation action and deoxidizes free oxygen (Of) in molten steel before casting to thereby makes Of necessary for formation of large-sized spherical MnS short. This adverse effect is significant and hard oxides form to deteriorate the machinability significantly, if the steel product contains Si in an amount exceeding 0.01%. Thus, the Si content is reduced to 0.01% or less.

N: 0.007% to 0.02%

N is an important element to control the hardness of pro-eutectoid ferrite to the range from HV of 133 to 150 by the action of solid solution strengthening, as P mentioned above. N also plays an important role to make the dynamic strain aging of a steel product noticeable by the action of solid solution strengthening. The dynamic strain aging of steel product stabilizes the formation of built-up edge. If the steel product has such noticeable dynamic strain aging, the built-up edge stably forms with uniformized size and shape. In addition, such a noticeable dynamic strain aging of steel product increases the difference in deformation resistance between 200° C. and 25° C. in the compression test so as to be controlled within the above-specified range. N also serves to improve the machinability typified by surface roughness.

To exhibit these advantages, the steel product must contain 0.007% or more of N, these advantages are excessively small at a N content less than 0.007%. In contrast, if the steel product contains N in an amount exceeding 0.02%, the hardness of pro-eutectoid ferrite becomes excessively high and/or the workability typically in hot rolling decreases. The lower and upper limits of N are thereby set at 0.007% and 0.02%, respectively.

Dissolved Nitrogen

The steel product preferably has a dissolved nitrogen (dissolved N) content of 70 ppm or more, in addition to the above-specified preferred total N content, for sufficiently exhibiting the advantages of N, and especially for increasing the dynamic strain aging of the steel product. If the steel product contains dissolved nitrogen in an amount of less than 70 ppm, it may not have a sufficiently increased dynamic strain aging and may fail to increase the difference in deformation resistance between 200° C. and 25° C. in the compression test, even when the total N content is high.

To increase the dissolved nitrogen content in the steel product, the amounts of nitride-forming elements such as Ti, Nb, V, Al and Zr should be decreased, as mentioned later. It is also effective to elevate the heating temperature in a final hot working (hot rolling or hot forging) and/or to increase the cooling rate after the hot working.

The dissolved nitrogen content of a steel product is determined by calculation according to the following equation by determining the total content of N (total nitrogen) in the steel product, and subtracting the content of compound nitrogen (deposited nitrogen) from the total nitrogen. The content of compound nitrogen is quantitatively determined by electrolytically extracting such compounded nitrogen from the steel product and assaying the content by indophenol absorptiometry. Dissolved nitrogen content (ppm)=(Total nitrogen content)−(Compound nitrogen content)

Oxygen

Upon casting of a steel product having the above-specified composition, free oxygen (Of) in molten steel before casting is controlled to 30 ppm or more and less than 100 ppm, and the ratio Of/S of Of to S is controlled to 0.005 to 0.030 according to the present invention. The term "MnS" as used in the present invention includes MnS into which oxygen is dissolved to form a solid solution, and MnS being composited with an oxide, in addition to compounds mainly comprising S, typified by MnS. Oxygen to be dissolved in MnS or to be composited with MnS significantly affects the size and configuration of MnS. These MnS substances form in molten steel before casting. Accordingly, controlling the oxygen content in the resulting steel product is insignificant, and controlling the content of free oxygen in molten steel before casting is significant. More specifically, the configuration of MnS is determined by Of content in molten steel before casting, and MnS can have a large size and spherical shape to thereby improve the machinability, by controlling Of in molten steel before casting.

If Of is less than 30 ppm and Of/S is less than 0.005 in molten steel before casting, MnS may not have a large size and spherical shape and may fail to serve to improve the machinability. In contrast, if Of exceeds 100 ppm and Of/S exceeds 0.030, such excessive Of may invite blow holes.

The Of content in molten steel is controlled by appropriately selecting one or more means such as control of MnS content, control of elements which intensively deoxidize, such as Al and Si, control of the composition of slag cover, and carrying out casting after forcedly adding FeO and before reaching an equilibrium.

The Of content in molten steel is determined by measuring an electromotive force, and converting the electromotive force into an oxygen content with a computing unit to thereby determine free oxygen. The electromotive force is determined by using a commercially available immersion exhaustion molten-steel product oxygen sensor including an oxygen concentration cell and a thermocouple serving as a temperature sensor. The measurement and computing of the electromotive force herein is carried out using YAMARI-ELECTRONITE CO., LTD HY-OP DIGITAL INDICATOR MODEL.

Cr and Ti, Nb, V, Al, Zr

Cr, Ti, Nb, V, Al and Zr fix the dissolved N that is effective for improving the machinability to thereby form nitrides. These elements reduce the dissolved N content to thereby deteriorate the machinability. The adverse effect is noticeable when the steel contains Cr in an amount exceeding 0.04%, and/or it contains Ti, Nb, V, Al and Zr in a total amount exceeding 0.020%. These elements should preferably be minimized in the present invention. Accordingly, the Cr content is controlled to preferably 0.04% or less, and more preferably 0.020% or less. The total content of Ti, Nb, V, Al and Zr is controlled to preferably 0.020% or less, more preferably 0.015% or less, and further preferably 0.010% or less.

Cu and Ni

Cu and Ni are dissolved in ferrite to form a solid solution to thereby strengthen ferrite. These elements are effective for controlling the hardness of pro-eutectoid ferrite to the range of HV of 133 to 150 and can be used in combination with N mentioned above. To exhibit this advantage, the content of Cu is more than 0.30% and equal to or less than 1.0%, and the content of Ni is more than 0.20% and equal to or less than 1.0% when Cu and/or Ni is selectively contained in the steel product. The steel product may not exhibit these advantages if the Cu content is 0.30% or less or the Ni content is 0.20% or less. The advantages become saturated if the Cu content exceeds 1.0% or the Ni content exceeds 1.0%.

Configuration of MnS

The configuration of MnS (sulfide inclusions) in the steel product will be illustrated in detail below. The amount and distribution of MnS are substantially determined by the composition of the steel product and conditions for melting and casting, as described above, but the configuration thereof varies also in the process of hot rolling or hot forging after casting. If MnS has a large-sized spherical shape, it is resistant to flattening and has a configuration varying within a wide range even after working. The width of MnS significantly affects the machinability of a hot rolled steel product or a steel product being subjected to cold working, such as wire drawing, after hot rolling. The machinability generally increases with an increasing width of MnS. However, the required average width of MnS varies depending on the diameter of the steel product. For example, the machinability increases with a decreasing diameter of the steel product and decreases with an increasing diameter thereof, provided that MnS with the identical volume, number and configuration (width) is contained in the steel product. Noting the configuration, the machinability can be improved by allowing MnS to have a sufficient width, even when the diameter of the steel product is large.

In the relationship between the average width of MnS and the diameter (gauge) of the steel product which affects the machinability, the required average width should be 2.8*(log d) [=2.8×(log d)] or more, wherein d represents the diameter of the steel product (wire rod or steel bar after rolling). If the average width of MnS is less than this value, the machinability decreases.

As is described above, the term "MnS" as used in the present invention includes, in addition to compounds mainly comprising S, typified by MnS, MnS into which oxygen is dissolved to form a solid solution, and MnS being composited with an oxide. These sulfides are also effective for improving the machinability. The maximum width of each MnS is determined by analyzing an image obtained by observation under an optical microscope at a magnification of 100 times. The observation points are important, and the region mentioned below should be observed. The region which is most important for the machinability is a region from a depth of 0.1 mm from the outer peripheral surface of the steel product to a depth of d/8, and this region should be observed. Such a region with an area of 6 $mm^2$ or more in a plane parallel with a rolling direction should be observed. It is enough to polish the outer peripheral surface of the steel product before observation, and there is no need of etching. The maximum width is measured and analyzed after excluding MnS having a major axis of less than 1 μm. This is because, such MnS having a major axis of less than 1 μm shows a large measurement error and does not so much affect the machinability.

In this connection, above-mentioned Patent Document 10 specifies that the minor axis is 2 μm or more as an specifying factor of MnS. Such a uniform specification regardless of the diameter of a steel product, however, does not contribute to improvement in machinability when the steel product has a large diameter, unless the maximum width of MnS is increased.

Production Method

Preferred production conditions of the steel product according to the present invention will be described below.

Initially, upon melting and casting of a steel product having the above-specified composition, free oxygen (Of) in molten steel before casting is controlled to 30 ppm or more and less than 100 ppm, and the ratio Of/S of Of to S is controlled to 0.005to 0.030 according to the present invention, for allowing MnS to have a large size and spherical shape to thereby improve the machinability.

A billet (strand) is heated in hot rolling at temperatures of preferably 1000° C. or higher, and more preferably 1040° C. or higher, for controlling the maximum width of MnS. The heating temperature of the billet is measured at the time when the billet is delivered out of a heating furnace.

The temperature of the subsequent hot rolling is effectively set in the ferrite region or ferrite-austenite region, for allowing the low-carbon resulfurized free machining steel product of the present invention to have a composite structure of ferrite and pearlite and to control the hardness of pro-eutectoid ferrite to a range of HV of 133 to 150 for further higher machinability.

Control of the cooling rate after hot rolling is important to control the hardness of pro-eutectoid ferrite to a range of HV of 133 to 150 or to control the difference in deformation resistance between 200° C. and 25° C. in the compression test to the above-specified range. Air blast cooling in a Stelmor line and/or accelerated cooling such as water cooling or mist cooling after hot rolling is effective to increase the hardness of pro-eutectoid ferrite. Only the hardness of pro-eutectoid ferrite can be increased without changing the composite structure of ferrite and pearlite by increasing the cooling rate immediately after ferrite transformation. This controls the difference in deformation resistance between 200° C. and 25° C. in the compression test to the above-specified range.

When a hot-rolled steel wire rod is cooled in a Stelmor line, the wire rod is preferably cooled by air cooling at an average cooling rate V (°C./s) between immediately after the wire rod is substantially placed on the Stelmor line and at the time the work reaches 500° C. or below of 1.0° C./s or more. The phrase "substantially placed" means that the rod wire is placed at the first point where an air cooling device is arranged. The "cooling rate" of a wire rod when cooled in a Stelmor conveyer means the average of cooling rates of the wire rod, while these rates vary between thick and thin portions in the wire rod coil, strictly speaking.

The wire rod and steel bar after hot rolling are subjected to cold working such as wire drawing or dowing out according to necessity, and to machining to thereby yield products.

EXAMPLE 1

Examples of the present invention will be illustrated below. Initially, the improvement effect of machinability of a steel wire by controlling the hardness of pro-eutectoid ferrite was verified in Examples 1 and 2.

A series of steel wires having various compositions were produced under various hot rolling conditions with actual equipment. The machinability and other properties of the steel rods were evaluated respectively. Specifically, low carbon billets having Compositions 1 to 14 shown in following Tables 1 and 2 were prepared by melting and casting, at a cooling rate in casting solidification of 20° C./S. Table 2 is continued from Table 1 and also shows Of contents and Of/S in molten steels before casting.

These billets were subjected to heating and hot rolling under conditions shown in Table 3 below, to thereby yield steel wire rods having wire diameters shown in Table 3. The cooling rates after rolling shown in Table 3 refer to average cooling rates in the case where a sample steel wire rod after finish rolling was placed on a Stelmor conveyer, air blast cooling was then started to cool the steel wire rod to 500° C., except for the case of Rolling Pattern C. In Rolling Pattern C marked with asterisk (*) in Table 3, a steel wire rod was cooled to 600° C. at an average cooling rate of 0.8° C./s and was subjected to accelerated cooling at 2.5° C./s at temperatures below 600° C. The cooling rates after hot rolling were suitably controlled by combination of parameters such as control of ring pitch of a coil wire rod, use of a slow-cooling cover, and control of the volume and direction of air in air cooling.

Table 3 shows the average widths of MnS of the produced steel wire rods, the relations between the average width of MnS and the diameter (d) of the steel products (2.8*(log d)), and hardness (HV) of pro-eutectoid ferrite. These were determined by the above-mentioned methods. The structures of the resulting steel wire rods were observed to find that they are all ferrite-pearlite structures.

The produced steel wire rods were subjected to a machinability test. In the machinability test, a sample wire rod, from which scale had been removed by cutting or centerless grinding, was fixed to a lathe so as to rotate around its shaft center, a high-speed steel product tool (SKH4) was vertically slotted into the wire rod for forming, and the finished surface roughness after cutting was determined. Forming was carried out at a cutting rate of 92 m/min, a tool feeding rate of 0.03 mm/rev, and a depth of cut of 1.0 mm. The finished surface roughness herein was defined as the center-line-average height Ra (μm) determined by the surface roughness measuring method specified in Japanese Industrial Standards (JIS) B0601.

Tables 1 to 3 show that material Steels 2, 3 and 6 shown in Table 1 for the steel wire rods of Inventive Samples 2 to 11 and 14 have chemical compositions within the range specified in the present invention and have contents of Mn and S satisfying the following conditions: $0.40 \leqq Mn*S \leqq 1.2$ and $Mn/S \geqq 3.0$. These steel wire rods each have a Of within a range of 30 ppm or more and less than 100 ppm, and the ratio Of/S within a range of 0.005 to 0.030 in molten steel before casting. The rolling conditions therefor are within the above-specified preferred range.

The resulting steel wire rods each have an average width (μm) of sulfide inclusions of 2.8*(log d) or more and a hardness of pro-eutectoid ferrite in metallographic structure of HV of 133 to 150. Accordingly, they have a finished surface roughness Ra of 33.6 μm or less (27.9 to 33.6 μm). The finished surface roughness is superior to that in above-mentioned Patent Document 6, 34.8 to 40.3 μm, in which the number, size and configuration of sulfide inclusions are controlled as in the present invention.

In contrast, Comparative Samples 1, 12, 15, and 19 to 22 each have a finished surface roughness Ra of 37.5 to 48.2 μm and show machinability markedly inferior to the inventive samples. In Comparative Samples 13 and 16 to 18, steel wire rods could not be obtained, since cracking occurred during rolling.

For example, material Steel 1 for Comparative Sample 1 has a low Mn*S less than the lower limit of 0.40, as shown in Table 1. Material Steel 4 for Comparative Sample 12 has a low Of less than the lower limit of 30 ppm and a low Of/S less than the lower limit of 0.005 in molten steel before casting, as shown in Table 2. Thus, Comparative Sample 12 has a low average width (μm) of MnS of less than 2.8*(log d).

Comparative Sample 15 was prepared from material Steel 7 shown in Table 2 having a low Of of less than the lower limit of 30 ppm in molten steel before casting and thereby has a low average width (μm) of MnS of less than 2.8*(log d).

Comparative Sample 19 was prepared from material Steel 11 having a high Mn content of 2.2%, higher than the upper limit of 2.0%, as shown in Table 1 and having low Of and Of/S in molten steel before casting less than the lower limits, as shown in Table 2.

Comparative Sample 20 was prepared from material Steel 12 having a S content of 0.28%, lower than the lower limit of 0.3% and thereby has an average width (μm) of MnS lower than 2.8*(log d).

Comparative Samples 21 and 22 were prepared from material Steels 13 and 14, respectively, having low N contents less than the lower limit of 0.007% and thereby have a low hardness of pro-eutectoid ferrite less than HV of 133.

These results show critical meanings of the requirements in the present invention.

TABLE 1

| | Chemical composition of steel (percent by mass, the remainder being Fe and impurities) | | | | | | | | | | | | | | |
|---|---|---|---|---|---|---|---|---|---|---|---|---|---|---|---|
| No. | C | Si | Mn | P | S | N | Cr | Cu | Ni | Ti | Al | V | Nb | Zr | Total content of Ti, Al, V, Nb and Zr |
| 1 | 0.05 | 0.005 | 1.2 | 0.08 | 0.33 | 0.008 | 0.03 | 0.05 | 0.02 | 0.001 | 0.001 | 0.006 | 0.001 | 0.001 | 0.010 |
| 2 | 0.04 | 0.005 | 1.5 | 0.07 | 0.4 | 0.008 | 0.02 | 0.03 | 0.01 | 0.001 | 0.001 | 0.003 | 0.001 | 0.001 | 0.007 |
| 3 | 0.06 | 0.005 | 1.8 | 0.08 | 0.5 | 0.011 | 0.03 | 0.02 | 0.01 | 0.002 | 0.001 | 0.003 | 0.001 | 0.001 | 0.008 |
| 4 | 0.07 | 0.005 | 1.9 | 0.08 | 0.55 | 0.008 | 0.03 | 0.03 | 0.01 | 0.001 | 0.001 | 0.003 | 0.001 | 0.001 | 0.007 |
| 5 | 0.08 | 0.005 | 1.3 | 0.07 | 0.45 | 0.007 | 0.04 | 0.04 | 0.02 | 0.002 | 0.001 | 0.002 | 0.001 | 0.001 | 0.007 |
| 6 | 0.05 | 0.006 | 1.5 | 0.07 | 0.4 | 0.009 | 0.03 | 0.03 | 0.01 | 0.002 | 0.001 | 0.003 | 0.001 | 0.001 | 0.008 |
| 7 | 0.04 | 0.005 | 1.8 | 0.08 | 0.55 | 0.015 | 0.02 | 0.02 | 0.01 | 0.002 | 0.001 | 0.003 | 0.001 | 0.001 | 0.008 |
| 8 | 0.06 | 0.005 | 1.1 | 0.08 | 0.38 | 0.014 | 0.01 | 0.03 | 0.02 | 0.002 | 0.001 | 0.004 | 0.001 | 0.001 | 0.009 |
| 9 | 0.08 | 0.005 | 1.5 | 0.08 | 0.52 | 0.009 | 0.02 | 0.03 | 0.01 | 0.001 | 0.001 | 0.003 | 0.001 | 0.001 | 0.007 |
| 10 | 0.07 | 0.005 | 0.8 | 0.08 | 0.35 | 0.011 | 0.03 | 0.02 | 0.01 | 0.002 | 0.001 | 0.003 | 0.001 | 0.001 | 0.008 |
| 11 | 0.08 | 0.007 | 2.2 | 0.08 | 0.56 | 0.008 | 0.02 | 0.02 | 0.02 | 0.001 | 0.001 | 0.003 | 0.001 | 0.001 | 0.007 |
| 12 | 0.08 | 0.005 | 1.1 | 0.08 | 0.28 | 0.007 | 0.03 | 0.02 | 0.01 | 0.002 | 0.001 | 0.003 | 0.001 | 0.001 | 0.008 |
| 13 | 0.07 | 0.007 | 1.3 | 0.08 | 0.38 | 0.004 | 0.03 | 0.03 | 0.01 | 0.002 | 0.001 | 0.003 | 0.001 | 0.001 | 0.008 |
| 14 | 0.05 | 0.005 | 1.5 | 0.07 | 0.45 | 0.005 | 0.03 | 0.02 | 0.01 | 0.002 | 0.001 | 0.003 | 0.001 | 0.001 | 0.008 |

TABLE 2

(continued from Table 1)

| No. | Chemical composition of steel (percent by mass) Of | Of/S | Mn/S | Mn * S |
|---|---|---|---|---|
| 1 | 0.0053 | 0.0161 | 3.6364 | 0.396 |
| 2 | 0.0048 | 0.012 | 3.75 | 0.6 |
| 3 | 0.0036 | 0.0072 | 3.6 | 0.9 |
| 4 | 0.0026 | 0.0047 | 3.4545 | 1.045 |
| 5 | 0.0052 | 0.0116 | 2.8889 | 0.585 |
| 6 | 0.0065 | 0.0163 | 3.75 | 0.6 |
| 7 | 0.0028 | 0.0051 | 3.2727 | 0.99 |
| 8 | 0.0065 | 0.0171 | 2.8947 | 0.418 |
| 9 | 0.0039 | 0.0075 | 2.8846 | 0.78 |
| 10 | 0.0105 | 0.03 | 2.2857 | 0.28 |
| 11 | 0.0019 | 0.0034 | 3.9286 | 1.232 |
| 12 | 0.007 | 0.025 | 3.9286 | 0.308 |
| 13 | 0.0063 | 0.0166 | 3.4211 | 0.494 |
| 14 | 0.0048 | 0.0107 | 3.3333 | 0.675 |

ferrite. Table 6 also shows the finished surface roughness of the produced steel wire rods as determined in a machinability test. The structures of the resulting steel wire rods were observed to find that they are all ferrite-pearlite structures.

Tables 4 to 6 demonstrate that Steels 15 to 18, and 23 to 26 shown in Table 4 as materials for Inventive Samples 23 to 26 and 31 to 34 have chemical compositions within the range specified in the present invention and have such Mn and S contents as to satisfy the following conditions: $0.40 \leqq Mn*S \leqq 1.2$ and $Mn/S \geqq 3.0$. In addition, Of is controlled to a range of 30 ppm or more and less than 100 ppm, and the ratio Of/S is controlled to a range of 0.005 to 0.030 in molten steel before casting. The rolling conditions therefor are within the above-specified preferred range.

The resulting steel wire rods each have an average width (μm) of sulfide inclusions of 2.8*(log d) or more and a hardness of pro-eutectoid ferrite in metallographic structure of HV of 133 to 150. Accordingly, they have a finished surface roughness Ra of 37.6 μm or less (30.9 to 37.6 μm).

TABLE 3

| | | Hot rolling condition | | | | Steel wire | | | | Machinability | | |
|---|---|---|---|---|---|---|---|---|---|---|---|---|
| | | | | | | | MnS | | | | | |
| No. | Steel No. in Table 1 | Heating temperature (° C.) | Finish rolling temperature (° C.) | Cooling rate ° C./min | Rolling pattern | Wire diameter (mm) | 2.8 * (log d) | Average width (μm) | Hardness of pro-eutectoid ferrite (HV) | Finished surface roughness Ra (μm) | Remarks | Category |
| 1 | 1 | 1010 | 850 | 0.8 | A | 8.0 | 2.53 | 2.82 | 132 | 37.5 | | Comparative |
| 2 | 2 | 1010 | 850 | 0.8 | A | 8.0 | 2.53 | 2.72 | 134 | 33.6 | | Inventive |
| 3 | 2 | 1010 | 855 | 1.8 | B | 6.2 | 2.21 | 2.39 | 136 | 30.2 | | Inventive |
| 4 | 2 | 1010 | 855 | 1.8 | B | 10.0 | 2.80 | 3.15 | 137 | 29.7 | | Inventive |
| 5 | 2 | 1010 | 855 | 1.8 | B | 8.0 | 2.53 | 2.73 | 135 | 30.1 | | Inventive |
| 6 | 2 | 1005 | 860 | * | C | 8.0 | 2.53 | 2.79 | 140 | 28.6 | | Inventive |
| 7 | 2 | 1020 | 705 | 1.3 | D | 8.0 | 2.53 | 2.71 | 142 | 27.9 | | Inventive |
| 8 | 3 | 1010 | 850 | 0.8 | A | 8.0 | 2.53 | 2.56 | 135 | 34.9 | | Inventive |
| 9 | 3 | 1010 | 850 | 0.8 | A | 8.0 | 2.53 | 2.59 | 137 | 33.6 | | Inventive |
| 10 | 3 | 1005 | 860 | * | C | 8.0 | 2.53 | 2.57 | 142 | 30.1 | | Inventive |
| 11 | 3 | 1020 | 705 | 1.3 | D | 8.0 | 2.53 | 2.61 | 144 | 29.8 | | Inventive |
| 12 | 4 | 1010 | 850 | 0.8 | A | 8.0 | 2.53 | 2.03 | 134 | 42.6 | | Comparative |
| 13 | 5 | 1010 | 850 | 0.8 | A | 8.0 | 2.53 | 2.83 | 135 | — | cracking | Comparative |
| 14 | 6 | 1010 | 850 | 0.8 | A | 8.0 | 2.53 | 2.91 | 135 | 32.5 | | Inventive |
| 15 | 7 | 1010 | 850 | 0.8 | A | 8.0 | 2.53 | 2.22 | 138 | 33.9 | | Comparative |
| 16 | 8 | 1010 | 850 | 0.8 | A | 8.0 | 2.53 | 2.83 | 135 | — | cracking | Comparative |
| 17 | 9 | 1010 | 850 | 0.8 | A | 8.0 | 2.53 | 2.29 | 135 | — | cracking | Comparative |
| 18 | 10 | 1010 | 850 | 0.8 | A | 8.0 | 2.53 | 2.84 | 132 | — | cracking | Comparative |
| 19 | 11 | 1010 | 850 | 0.8 | A | 8.0 | 2.53 | 1.85 | 138 | 47.0 | | Comparative |
| 20 | 12 | 1010 | 850 | 0.8 | A | 8.0 | 2.53 | 2.85 | 135 | 46.3 | | Comparative |
| 21 | 13 | 1010 | 850 | 0.8 | A | 8.0 | 2.53 | 2.89 | 129 | 48.2 | | Comparative |
| 22 | 14 | 1010 | 850 | 0.8 | A | 8.0 | 2.53 | 2.93 | 127 | 47.6 | | Comparative |

* Cooling to 600° C. at 0.8° C./s, and accelerated-cooling at 2.5° C./s thereafter
cracking: cracking in rolling
Comparative: Comparative Sample, Inventive: Inventive Sample

EXAMPLE 2

Next, a series of low carbon billets having Compositions 15 to 26 shown in Tables 4 and 5 were prepared by melting in the same way as Example 1. Table 5 is continued from Table 4 and shows Of contents and ratios Of/S in molten steel before casting. Hot rolling was carried out under Pattern B in Table 3 of Example 1. The machinability and other properties of the resulting steel wires prepared using actual equipment were evaluated in the same way as Example 1.

Table 6 shows the wire diameters and the average widths of MnS in the produced steel wire rods, the relations between the average width of MnS and the diameter (d) of the steel products [2.8*(log d)], and the hardness (HV) of pro-eutectoid In contrast, Comparative Samples 27 to 30 each have a finished surface roughness Ra of 43.6 to 48.3 μm and show machinability markedly inferior to the inventive samples.

For example, Comparative Sample 27 was prepared from Steel 19 shown in Table 4 having a high total content of Ti, Nb, V, Al and Zr exceeding the upper limit of 0.020%.

Comparative Sample 28 was prepared from Steel 20 shown in Table 4 having a low N content less than the lower limit of 0.007%.

Comparative Sample 29 was prepared from Steel 21 shown in Table 4 having a high N content exceeding the upper limit of 0.035% and thereby has deteriorated surface quality after cutting, whose finished surface roughness Ra could not be determined.

Comparative Sample 30 has a high hardness of pro-eutectoid ferrite exceeding the upper limit.

These results show critical meanings of the requirements in the present invention.

TABLE 4

| | Chemical composition of steel (percent by mass, the remainder being Fe and impurities) | | | | | | | | | | | | | | |
|---|---|---|---|---|---|---|---|---|---|---|---|---|---|---|---|
| No. | C | Si | Mn | P | S | N | Cr | Cu | Ni | Ti | Al | V | Nb | Zr | Total content of Ti, Al, V, Nb and Zr |
| 15 | 0.05 | 0.005 | 1.2 | 0.08 | 0.35 | 0.012 | 0.03 | 0.03 | 0.02 | 0.001 | 0.001 | 0.007 | 0.001 | 0.001 | 0.011 |
| 16 | 0.05 | 0.006 | 1.15 | 0.07 | 0.36 | 0.010 | 0.03 | 0.02 | 0.02 | 0.001 | 0.001 | 0.005 | 0.001 | 0.001 | 0.009 |
| 17 | 0.04 | 0.005 | 1.2 | 0.08 | 0.35 | 0.012 | 0.05 | 0.03 | 0.01 | 0.002 | 0.001 | 0.011 | 0.001 | 0.001 | 0.016 |
| 18 | 0.05 | 0.006 | 1.3 | 0.08 | 0.35 | 0.010 | 0.015 | 0.02 | 0.02 | 0.001 | 0.001 | 0.002 | 0.001 | 0.001 | 0.006 |
| 19 | 0.05 | 0.006 | 1.2 | 0.08 | 0.34 | 0.010 | 0.025 | 0.01 | 0.02 | 0.005 | 0.002 | 0.015 | 0.002 | 0.002 | 0.026 |
| 20 | 0.04 | 0.006 | 1.15 | 0.07 | 0.35 | 0.005 | 0.01 | 0.03 | 0.01 | 0.001 | 0.001 | 0.008 | 0.001 | 0.001 | 0.012 |
| 21 | 0.04 | 0.005 | 1.2 | 0.08 | 0.34 | 0.035 | 0.015 | 0.02 | 0.01 | 0.001 | 0.001 | 0.008 | 0.001 | 0.001 | 0.012 |
| 22 | 0.05 | 0.005 | 1.5 | 0.07 | 0.45 | 0.011 | 0.025 | 0.02 | 0.02 | 0.002 | 0.001 | 0.005 | 0.001 | 0.001 | 0.010 |
| 23 | 0.05 | 0.004 | 1.2 | 0.15 | 0.35 | 0.012 | 0.03 | 0.03 | 0.01 | 0.002 | 0.001 | 0.005 | 0.001 | 0.001 | 0.010 |
| 24 | 0.05 | 0.007 | 1.15 | 0.08 | 0.35 | 0.012 | 0.025 | 0.35 | 0.01 | 0.002 | 0.001 | 0.005 | 0.001 | 0.001 | 0.010 |
| 25 | 0.05 | 0.006 | 1.2 | 0.09 | 0.36 | 0.018 | 0.025 | 0.03 | 0.40 | 0.001 | 0.001 | 0.006 | 0.001 | 0.001 | 0.010 |
| 26 | 0.05 | 0.005 | 1.2 | 0.07 | 0.34 | 0.009 | 0.03 | 0.36 | 0.26 | 0.002 | 0.001 | 0.005 | 0.001 | 0.001 | 0.010 |

TABLE 5

(continued from Table 4)

| | Chemical composition of steel (percent by mass) | | | |
|---|---|---|---|---|
| No. | Of | Of/S | Mn/S | Mn * S |
| 15 | 0.0056 | 0.016 | 3.4286 | 0.42 |
| 16 | 0.0057 | 0.0158 | 3.1944 | 0.414 |
| 17 | 0.0065 | 0.0186 | 3.4286 | 0.42 |
| 18 | 0.0061 | 0.0174 | 3.7143 | 0.455 |
| 19 | 0.0056 | 0.0165 | 3.5294 | 0.408 |
| 20 | 0.0057 | 0.0163 | 3.2857 | 0.4025 |
| 21 | 0.0058 | 0.0171 | 3.5294 | 0.408 |

TABLE 5-continued (continued from Table 4)

| | Chemical composition of steel (percent by mass) | | | |
|---|---|---|---|---|
| No. | Of | Of/S | Mn/S | Mn * S |
| 22 | 0.0048 | 0.0101 | 3.3333 | 0.675 |
| 23 | 0.0059 | 0.0169 | 3.4286 | 0.42 |
| 24 | 0.0068 | 0.0194 | 3.2857 | 0.4025 |
| 25 | 0.0056 | 0.0156 | 3.3333 | 0.432 |
| 26 | 0.0055 | 0.0162 | 3.5294 | 0.408 |

TABLE 6

| | | | Steel wire | | | | Machinability | | |
|---|---|---|---|---|---|---|---|---|---|
| | Steel | Hot rolling | Wire | MnS | | Hardness of | Finished surface | | |
| No. | No. in Table 4 | condition Pattern | diameter (mm) | 2.8 * (log D) | Average width (μm) | pro-eutectoid ferrite (HV) | roughness Ra (μm) | Remarks | Category |
| 23 | 15 | B | 8.0 | 2.53 | 2.78 | 132 | 34.1 | | Inventive |
| 24 | 16 | B | 8.0 | 2.53 | 2.77 | 135 | 31.6 | | Inventive |
| 25 | 17 | B | 6.2 | 2.21 | 2.85 | 132 | 37.6 | | Inventive |
| 26 | 18 | B | 10.0 | 2.80 | 2.88 | 138 | 32.8 | | Inventive |
| 27 | 19 | B | 8.0 | 2.53 | 2.74 | 127 | 48.3 | | Comparative |
| 28 | 20 | B | 8.0 | 2.53 | 2.72 | 127 | 47.3 | | Comparative |
| 29 | 21 | B | 8.0 | 2.53 | 2.75 | 128 | — | decreased surface quality | Comparative |
| 30 | 22 | B | 8.0 | 2.53 | 2.68 | 152 | 43.6 | | Comparative |
| 31 | 23 | B | 8.0 | 2.53 | 2.77 | 136 | 35.2 | | Inventive |
| 32 | 24 | B | 8.0 | 2.53 | 2.96 | 140 | 31.6 | | Inventive |
| 33 | 25 | B | 8.0 | 2.53 | 2.73 | 139 | 30.9 | | Inventive |
| 34 | 26 | B | 8.0 | 2.53 | 2.75 | 142 | 31.9 | | Inventive |

Comparative: Comparative Sample,
Inventive: Inventive Sample

EXAMPLE 3

Improvement effect in machinability of steel wires by controlling the difference in deformation resistance between high temperatures and room temperature in a compression test of steel products was verified.

A series of low carbon billets having Compositions 27 to 41 shown in Tables 7 and 8 were prepared by melting in the same way as Example 1. Table 8 is continued from Table 7 and shows Of contents and ratios Of/S in molten steel before casting. The low carbon billets were subjected to hot rolling at heating temperatures, finish rolling temperatures and cooling rates shown in Table 9 using actual equipment to thereby yield steel wires each having a diameter of 8.0 mm. The machinability and other properties of the steel wires were evaluated respectively.

The cooling rates after rolling shown in Table 9 refer to average cooling rates in the case where a sample steel wire rod after finish rolling was placed on a Stelmor conveyer, air blast cooling was then started to cool the steel wire rod to 500° C., except for Rolling Pattern C. In Rolling Pattern C indicated in Table 9, a steel wire rod was cooled to 600° C. at an average cooling rate of 0.8° C./s and was subjected to accelerated cooling at 2.5° C./s from temperatures below 600° C. to room temperature. The cooling rates after hot rolling were suitably controlled by combination of parameters such as control of ring pitch of a coil wire rod, use of a slow-cooling cover, and control of the volume and direction of air in air cooling.

Table 10 shows the average widths of MnS, the relations between the average width of MnS and the diameter (d) of the steel products [2.8*(log d)], the difference in deformation resistance between 200° C. and 25° C. in the compression test, and the dissolved N contents of the produced steel wire rods. The structures of the steel wire rods were observed to find that they are all ferrite-pearlite structures.

The deformation resistance was evaluated by subjecting a cylindrical steel wire rod test piece having a diameter of 8 mm and a height of 12 mm to a compression test at 25° C. (room temperature) and at an elevated temperature of 200° C. In the compression test, a slice of carbide was sandwiched between the steel wire rod test piece and a compression jig to reduce friction, and deformation resistances at a strain of 0.3 at the above-mentioned temperatures were determined at a deformation rate of 0.3 mm/min in compression of the steel wire rod test piece.

The average width of MnS and the dissolved N content in a sample steel wire rod were determined by the above-mentioned methods.

The machinability of the produced steel wire rods was evaluated by measuring the finished surface roughness under the same test condition as in Example 1. These results are also shown in Table 10.

Steel 41 shown in Tables 7 and 8 has a chemical composition within the range specified in the present invention, has such Mn and S contents as to satisfy the following conditions: $0.40 \leqq Mn*S \leqq 1.2$ and $Mn/S \geqq 3.0$, and its molten steel before casting has an Of within a range of 30 ppm or more and less than 100 ppm and a ratio Of/S within a range of 0.005 to 0.030.

Table 10 demonstrates that, of the steel wire rods prepared by using Steel 41, Inventive Samples 49, 51 and 52 were rolled under preferred rolling and cooling conditions (B, C and E) shown in Table 9, respectively, and have a dissolved N content within a preferred range, i.e., 70 ppm or more. The resulting steel wire rods of the inventive samples each have an average width (μm) of sulfide inclusions of 2.8*(log d) or more and a difference in deformation resistance between 200° C. and 25° C. in the compression test of 110 MPa or more and 200 MPa or less, as specified in the present invention. They have a finished surface roughness Ra of about 27.6 μm to about 31.5 μm.

Inventive Samples 49, 51 and 52 also each have a hardness of pro-eutectoid ferrite of HV of 136 to 142 within the specified range in the present invention.

In contrast, Comparative Sample 50 was prepared from the same Steel 41 but was cooled at an excessively low cooling rate under Rolling Condition A indicated in Table 9. Thus, Comparative Sample 50 has a low dissolved N content of 63 ppm and a low difference in deformation resistance between 200° C. and 25° C. in the compression test of 103, less than the lower limit, although it has an average width (μm) of sulfide inclusions of 2.8*(log d) or more. Therefore, Comparative Sample 50 has a finished surface roughness Ra of about 36.8 and exhibits machinability inferior to Inventive Samples 49, 51 and 52.

Comparative Sample 35 was rolled under preferred Rolling and Cooling Condition B shown in Table 9, but its material Steel 27 has a low Mn*S less than the lower limit of 0.40 and has a low dissolved N content of 52 ppm, as shown in Table 10. Resulting Comparative Sample 35 has a difference in deformation resistance between 200° C. and 25° C. in the compression test of as low as 95, less than the lower limit, has a poor finished surface roughness Ra of about 38.9 and exhibits machinability inferior to the inventive samples.

Inventive Sample 36 was prepared from Steel 28 having a chemical composition within the range specified in the present invention by rolling under preferred Rolling and Cooling Condition B shown in Table 9, and has a dissolved N content within a preferred range, i.e., 70 ppm or more. The resulting steel wire rod has an average width (μm) of sulfide inclusions of 2.8*(log d) or more and a difference in deformation resistance between 200° C. and 25° C. in the compression test of 110 MPa or more and200MPa or less within the range specified in the present invention. It exhibits satisfactory machinability in terms of a finished surface roughness Ra of about 33.6 μm.

Comparative Sample 37 was prepared from material Steel 29 having, as shown in Table 8, a low Of of less than the lower limit of 30 ppm and a low ratio Of/S of less than the lower limit of 0.005 in molten steel before casting. The resulting steel wire rod therefore has an average width (μm) of sulfide inclusions of less than 2.8 *(log d) and has a low dissolved N content of 60 ppm, although it was rolled under preferred Rolling and Cooling Condition B shown in Table 9. Comparative Sample 37 thereby shows a low difference in deformation resistance between 200° C. and 25° C. in the compression test of 102 less than the lower limit, thereby has a poor finished surface roughness Ra of about 42.6 and exhibits machinability inferior to the inventive samples.

Steel 30 used as a material for Comparative Sample 38 has, as shown in Tables 7 and 8, a chemical composition within the range specified in the present invention and was subjected to rolling under preferred Rolling and Cooling Condition B, but it has a low dissolved N content of 53 ppm. Consequently, resulting Comparative Sample 38 has a low difference in deformation resistance between 200° C. and 25° C. in the compression test of 93, less than the lower limit, thereby has a poor finished surface roughness Ra of about 38.7 and exhibits machinability inferior to the inventive samples.

Steel 31 used as a material for Comparative Sample 39 has a low Of less than the lower limit of 30 ppm in molten steel before casting, as shown in Table 8. Resulting Comparative Sample 39 therefore has average width (μm) of sulfide inclusions in steel wire rod of less than 2.8*(log d), although it was subjected to rolling under preferred Rolling and Cooling Condition B shown in Table 9. Comparative Sample 39 thereby has a poor finished surface roughness Ra of about 39.2 and exhibits machinability inferior to the inventive samples.

Steel 32 used as a material for Comparative Sample 40 has a low ratio Mn/S less than the lower limit of 3.0, as shown in Table 8. This invited cracking during rolling, and the finished surface roughness Ra and other properties could not be evaluated, although rolling was carried out under preferred Rolling and Cooling Condition B in Table 9.

Steel 33 used as a material for Comparative Sample 41 has a low ratio Mn/S less than the lower limit of 3.0, as shown in Table 8. This invited cracking during rolling, and the finished surface roughness Ra and other properties could not be evaluated, although rolling was carried out under preferred Rolling and Cooling Condition B in Table 9.

Steel 34 used as a material for Comparative Sample 42 has a low Mn content less than the lower limit of 1.0%, as shown in Table 7. This invited cracking during rolling and the finished surface roughness Ra and other properties could not be evaluated, although rolling was carried out under preferred Rolling and Cooling Condition B in Table 9.

Steel 35 used as a material for Comparative Sample 43 has, as shown in Table 7, a high Mn content exceeding the upper limit of 2.0%. In addition, the Of is less than the lower limit of 30 ppm and a ratio Of/S of less than the lower limit of 0.005 in molten steel before casting. Comparative Sample 43 is therefore low in average width of sulfide inclusions in steel wire rod, dissolved N content and difference in deformation resistance between 200° C. and 25° C. in the compression test and has a poor finished surface roughness Ra of about 47.0 and exhibits machinability inferior to the inventive samples, although rolling was carried out under preferred Rolling and Cooling Condition B in Table 9.

Steel 36 used as a material for Comparative Sample 44 has a low S content of 0.28% less than the lower limit of 0.3%, as shown in Table 7. Resulting Comparative Sample 44 has a low Mn*S less than the lower limit of 0.40% as shown in Table 8 and is therefore low in dissolved N content and difference in deformation resistance between 200° C. and 25° C. in the compression test and has a poor finished surface roughness Ra of about 46.3 and exhibits machinability inferior to the inventive samples, although the rolling condition is preferred Rolling and Cooling Condition B in Table 9.

Steel 37 used as a material for Comparative Sample 45 has a low N content less than the lower limit of 0.007% as shown in Table 7. Resulting Comparative Sample 45 is therefore low in dissolved N content and difference in deformation resistance between 200° C. and 25° C. in the compression test, has a poor finished surface roughness Ra of about 48.2 and exhibits machinability inferior to the inventive samples, although rolling was carried out under preferred Rolling and Cooling Condition B in Table 9.

Steels 38, 39 and 40 used as materials for Comparative Samples 46, 47 and 48 have Of and Of/S in molten steel before casting exceeding the upper limits, respectively, as shown in Table 8. Resulting Comparative Samples 46, 47 and 48 are therefore low in dissolved N content and difference in deformation resistance between 200° C. and 25° C. in the compression test, have a poor finished surface roughness Ra of about 36.8 to about 48.7 and exhibit machinability inferior to the inventive samples, although rolling was carried out under preferred Rolling and Cooling Condition B in Table 9.

All the comparative samples have a hardness of pro-eutectoid ferrite out of the range of HV of 133 to 150 specified in the present invention, whereas the inventive samples have a hardness of pro-eutectoid ferrite within the specified range. Accordingly, the specification (requirement) in hardness of pro-eutectoid ferrite agrees with or satisfactorily corresponds to the specification in difference in deformation resistance between 200° C. and 25° C. These results show critical meanings of the requirements in the present invention.

TABLE 7

| | Chemical composition of steel (percent by mass, the remainder being Fe and impurities) | | | | | | | | | | | | | | |
|---|---|---|---|---|---|---|---|---|---|---|---|---|---|---|---|
| No. | C | Si | Mn | P | S | N | Cr | Cu | Ni | Ti | Al | V | Nb | Zr | Total content of Ti, Al, V, Nb and Zr |
| 27 | 0.05 | 0.005 | 1.2 | 0.08 | 0.33 | 0.008 | 0.03 | 0.05 | 0.02 | 0.001 | 0.001 | 0.006 | 0.001 | 0.001 | 0.010 |
| 28 | 0.06 | 0.005 | 1.8 | 0.08 | 0.5 | 0.011 | 0.03 | 0.02 | 0.01 | 0.002 | 0.001 | 0.003 | 0.001 | 0.001 | 0.008 |
| 29 | 0.07 | 0.005 | 1.9 | 0.08 | 0.55 | 0.008 | 0.03 | 0.03 | 0.01 | 0.001 | 0.001 | 0.003 | 0.001 | 0.001 | 0.007 |
| 30 | 0.05 | 0.006 | 1.5 | 0.07 | 0.4 | 0.007 | 0.03 | 0.03 | 0.01 | 0.003 | 0.001 | 0.003 | 0.001 | 0.001 | 0.008 |
| 31 | 0.04 | 0.005 | 1.8 | 0.08 | 0.55 | 0.015 | 0.02 | 0.02 | 0.01 | 0.002 | 0.001 | 0.003 | 0.001 | 0.001 | 0.008 |
| 32 | 0.06 | 0.005 | 1.1 | 0.08 | 0.38 | 0.014 | 0.01 | 0.03 | 0.02 | 0.002 | 0.001 | 0.004 | 0.001 | 0.001 | 0.009 |
| 33 | 0.08 | 0.005 | 1.5 | 0.08 | 0.52 | 0.009 | 0.02 | 0.03 | 0.01 | 0.001 | 0.001 | 0.003 | 0.001 | 0.001 | 0.007 |
| 34 | 0.07 | 0.005 | 0.8 | 0.08 | 0.35 | 0.011 | 0.03 | 0.02 | 0.01 | 0.002 | 0.001 | 0.003 | 0.001 | 0.001 | 0.008 |
| 35 | 0.08 | 0.007 | 2.2 | 0.08 | 0.56 | 0.008 | 0.02 | 0.02 | 0.02 | 0.001 | 0.001 | 0.003 | 0.001 | 0.001 | 0.007 |
| 36 | 0.08 | 0.005 | 1.1 | 0.08 | 0.28 | 0.007 | 0.03 | 0.02 | 0.01 | 0.002 | 0.001 | 0.003 | 0.001 | 0.001 | 0.008 |
| 37 | 0.07 | 0.007 | 1.3 | 0.08 | 0.38 | 0.004 | 0.03 | 0.03 | 0.01 | 0.002 | 0.001 | 0.003 | 0.001 | 0.001 | 0.008 |
| 38 | 0.05 | 0.005 | 1.2 | 0.08 | 0.35 | 0.012 | 0.03 | 0.03 | 0.02 | 0.001 | 0.001 | 0.007 | 0.001 | 0.001 | 0.011 |
| 39 | 0.05 | 0.006 | 1.2 | 0.07 | 0.36 | 0.010 | 0.03 | 0.02 | 0.02 | 0.001 | 0.001 | 0.005 | 0.001 | 0.001 | 0.009 |
| 40 | 0.04 | 0.005 | 1.2 | 0.08 | 0.35 | 0.012 | 0.05 | 0.03 | 0.01 | 0.002 | 0.001 | 0.011 | 0.001 | 0.001 | 0.016 |
| 41 | 0.07 | 0.005 | 1.8 | 0.08 | 0.49 | 0.012 | 0.02 | 0.02 | 0.01 | 0.002 | 0.001 | 0.003 | 0.001 | 0.001 | 0.008 |

TABLE 8

(continued from Table 7)

| No. | Chemical composition of steel (percent by mass) Of | Of/S | Mn/S | Mn * S |
|---|---|---|---|---|
| 27 | 0.0053 | 0.01606 | 3.636 | 0.396 |
| 28 | 0.0042 | 0.00840 | 3.600 | 0.900 |
| 29 | 0.0026 | 0.00473 | 3.455 | 1.045 |
| 30 | 0.0063 | 0.01575 | 3.750 | 0.600 |
| 31 | 0.0028 | 0.00509 | 3.273 | 0.990 |
| 32 | 0.0065 | 0.01711 | 2.895 | 0.418 |
| 33 | 0.0039 | 0.00750 | 2.885 | 0.780 |
| 34 | 0.0105 | 0.03000 | 2.286 | 0.280 |
| 35 | 0.0019 | 0.00339 | 3.929 | 1.232 |
| 36 | 0.007 | 0.02500 | 3.929 | 0.308 |
| 37 | 0.0063 | 0.01658 | 3.421 | 0.494 |
| 38 | 0.016 | 0.04571 | 3.429 | 0.420 |
| 39 | 0.0158 | 0.04398 | 3.194 | 0.414 |
| 40 | 0.0186 | 0.05306 | 3.429 | 0.420 |
| 41 | 0.0036 | 0.00735 | 3.673 | 0.882 |

TABLE 9

| Hot rolling condition Rolling pattern | Heating temperature (° C.) | Finish rolling temperature (° C.) | Cooling rate (° C./min) | Category |
|---|---|---|---|---|
| A | 1010 | 850 | 0.8 | Comparative Sample |
| B | 1010 | 855 | 1.8 | Inventive Sample |
| C | 1005 | 860 | Cooling at 0.8° C./s to 600° C., and accelerated-cooling at 2.5° C./s thereafter | Inventive Sample |
| E | 1150 | 855 | 1.8 | Inventive Sample |

TABLE 10

| No. | Steel No. in Tables 7 and 8 | Hot rolling condition Pattern in Table 9 | Steel wire Wire diameter (mm) | MnS 2.8 * (log d) | MnS Average width (μm) | Difference in deformation resistance in compression test (MPa) | Dissolved nitrogen (ppm) | Machinability Finished surface roughness Ra (μm) | Category |
|---|---|---|---|---|---|---|---|---|---|
| 35 | 27 | B | 8.0 | 2.53 | 2.53 | 95 | 52 | 38.9 | Comparative |
| 36 | 28 | B | 8.0 | 2.53 | 2.59 | 125 | 87 | 33.6 | Inventive |
| 37 | 29 | B | 8.0 | 2.53 | 2.03 | 102 | 60 | 42.6 | Comparative |
| 38 | 30 | B | 8.0 | 2.53 | 2.91 | 93 | 53 | 38.7 | Comparative |
| 39 | 31 | B | 8.0 | 2.53 | 2.22 | 113 | 103 | 39.2 | Comparative |
| 40 | 32 | B | 8.0 | 2.53 | 2.83 | 125 | 115 | — | Comparative |
| 41 | 33 | B | 8.0 | 2.53 | 2.29 | 111 | 70 | — | Comparative |
| 42 | 34 | B | 8.0 | 2.53 | 2.84 | 124 | 88 | — | Comparative |
| 43 | 35 | B | 8.0 | 2.53 | 1.85 | 99 | 60 | 47.0 | Comparative |
| 44 | 36 | B | 8.0 | 2.53 | 2.85 | 87 | 48 | 46.3 | Comparative |
| 45 | 37 | B | 8.0 | 2.53 | 2.89 | 65 | 18 | 48.2 | Comparative |
| 46 | 38 | B | 8.0 | 2.53 | 2.78 | 78 | 49 | 38.2 | Comparative |
| 47 | 39 | B | 8.0 | 2.53 | 2.77 | 72 | 34 | 36.8 | Comparative |
| 48 | 40 | B | 8.0 | 2.53 | 2.85 | 59 | 8 | 48.7 | Comparative |
| 49 | 41 | B | 8.0 | 2.53 | 2.86 | 115 | 72 | 31.5 | Inventive |
| 50 | 41 | A | 8.0 | 2.53 | 2.92 | 103 | 63 | 36.8 | Comparative |
| 51 | 41 | C | 8.0 | 2.53 | 3.01 | 116 | 76 | 29.2 | Inventive |
| 52 | 41 | E | 8.0 | 2.53 | 3.09 | 133 | 78 | 27.6 | Inventive |

Comparative: Comparative Sample,

Inventive: Inventive Sample

INDUSTRIAL APPLICABILITY

As is described above, the present invention provides a low-carbon resulfurized free machining steel product excellent in machinability typified by finished surface roughness even though toxic Pb or special elements such as Bi or Te are not added, and a suitable production method thereof. The steel products according to the present invention are useful typically for screws and nipples, which are small parts requiring excellent machinability and being produced by cutting in large quantity.

The invention claimed is:

1. A low-carbon resulfurized free machining steel product, comprising, on the percent by mass basis, C: 0.02% to 0.12%, Si: 0.01% or less, Mn: 1.0% to 2.0%, P: 0.05% to 0.20%, S: 0.35% to 0.60%, N: 0.007% to 0.03%, with the balance being Fe and inevitable impurities, the contents of and S satisfying the following conditions: 0.40<Mn*S<1.2 and Mn/S>3.0, and the steel product having a ferrite-pearlite structure, wherein the average width (μm) of sulfide inclusions in the steel product is 2.8*(log d) or more, wherein d is the diameter (mm) of the steel product, and pro-eutectoid ferrite in the metallographic structure has a hardness HV of 133 to 150.

2. A low-carbon resulfurized free machining steel product comprising, on the percent by mass basis, C: 0.02% to 0.12%, Si: 0.01% or less, Mn: 1.0% to 2.0%, P: 0.05% to 0.20%, S: 0.35% to 0.60%, N: 0.007% to 0.03%, with the balance being Fe and inevitable impurities, the contents of Mn and S satisfying the following conditions 0.40<Mn*S<1.2 and Mn/S>3.0, and the steel product having a ferrite-pearlite structure, wherein the average width (μm) of sulfide inclusions in the steel product is 2.8* (log d) or more, wherein d is the diameter (mm) the steel product, and a difference in deformation resistance at a strain of 0.3 between 200° C. and 25° C. is 110 MPa or more and 200 MPa or less, the deformation resistances being determined at a deformation rate of 0.3 mm/min in a compression test.

3. The low-carbon resulfurized free machining steel product according to claim 1, wherein the steel product further comprises 70 ppm or more of dissolved nitrogen.

4. The low carbon resulfurized free machining steel product according to claim 1, wherein the machining steel product comprises a Cr content of not more than 0.04%, and wherein the total content of Ti, Nb, V, Al and Zr is not more than 0.020%.

5. The low-carbon resulfurized free machining steel product according to claim 1, further comprising on or both of Cu: more than 0.30% and equal to or less than 1.0% and Ni: more than 0.20% an equal to or less than 1.0%.

6. A method for producing a low-carbon resulfurized free machining steel product, comprising casting steel having the composition as defined in claim 1, and controlling, before the casting, free oxygen (Of) to a content of 30 ppm or more and less than 100 ppm and the ratio Of/S to within a range from 0.005 to 0.030, Of and S being contained in molten steel before casting.

7. The low-carbon resulfurized free machining steel product according to claim 2, wherein the steel product further comprises 70 ppm or more of dissolved nitrogen.

8. The low-carbon resulfurized free machining steel product according to claim 2, wherein the machining steel product comprises a Cr content of not more than 0.04%, and wherein the total content o Ti, Nb, V. Al and Zr is not more than 0.020%.

9. The low-carbon resulfurized free machining steel product according to claim 3, wherein the machining steel product comprises a Cr content of not more than 0.04%, and wherein the total content o Ti, Nb, V, Al and Zr is not more than 0.020%.

10. The low-carbon resulfurized free machining steel product according to claim 2, further comprising one or both of Cu: more than 0.30% and equal to or less than 1.0% and Ni: more than 0.20% and equal to or less than 1.0%.

11. The low-carbon resulfurized free machining steel product according to claim 3, further comprising one or both of Cu: more than 0.30% and equal to or less than 1.0% and Ni: more than 0.20% and equal to or less than 1.0%.

12. The low-carbon resulfurized free machining steel product according to claim 4, further comprising one r both of Cu: more than 0.30% and equal to or less than 1.0% and Ni: more than 0.20% and equal to or less than 1.0%.

13. A method for producing a low-carbon resulfurized free machining steel product, comprising casting a steel having the composition as defined in claim 2, and controlling, before the casting, free oxygen (Of) to a content of 30 ppm or more and less than 100 ppm and the ratio Of/S to within a range from 0.005 to 0.030, Of and S being contained in molten steel before casting.

14. A method for producing a low-carbon resulfurized free machining steel product, comprising casting a steel having the composition as defined in claim 3, and controlling, before the casting, free oxygen (Of) to a content of 30 ppm or more and less than 100 ppm and the ratio Of/S to within a range from 0.005 to 0.030, Of and S being contained in molten steel before casting.

15. A method for producing a low-carbon resulfurized free machining steel product, comprising casting steel having the composition as defined in claim 4, and controlling, before the casting, free oxygen (Of) to a content of 30 ppm or more and less than 100 ppm and the ratio Of/S to within a range from 0.005 to 0.030, Of and S being contained in molten steel before casting.

16. A method for producing a low-carbon resulfurized free machining steel product, comprising casting steel having the composition as defined in claim 5, and controlling, before the casting, free oxygen (Of) to a content of 30 ppm or more and less than 100 ppm and the ratio Of/S to within a range from 0.005 to 0.030, Of and S being contained in molten steel before casting.

17. The steel product of claim 1, in the form of a nipple.

18. The steel product of claim 1, in the form of a screw.

19. The steel product of claim 1, in the form of a wire rod.

20. The steel product of claim 1, in the form of a steel bar.

* * * * *